US005207891A

United States Patent [19]

Sung et al.

[11] Patent Number: 5,207,891

[45] Date of Patent: May 4, 1993

[54] COMPOSITION OF MATTER FOR OLIGOMERIC ALIPHATIC ETHER ASPHALTENES AS ASPHALTENE DISPERSANTS

[75] Inventors: Rodney L. Sung, Fishkill, N.Y.; Thomas F. DeRosa, Passaic; David A. Storm, Montvale, both of N.J.; Benjamin J. Kaufman, Hopewell Jct., N.Y.

[73] Assignee: Texaco Inc., White Plains, N.Y.

[21] Appl. No.: 814,536

[22] Filed: Dec. 30, 1991

[51] Int. Cl.[5] ..... C10C 3/02; C10L 1/26

[52] U.S. Cl. ..... 208/44; 524/64; 252/351; 106/284.1; 208/22; 44/280; 44/281

[58] Field of Search ..... 252/311.5, 8.511, 8.513, 252/351; 524/64; 106/284.1, 284.2; 44/280, 281; 208/44, 22

[56] References Cited

U.S. PATENT DOCUMENTS

| | | | |
|---|---|---|---|
| 4,399,024 | 8/1983 | Fukui et al. | 208/44 X |
| 4,469,585 | 9/1984 | Cukier et al. | 208/44 X |
| 4,757,833 | 7/1988 | Danley | 137/13 |
| 4,775,489 | 10/1988 | Watkins et al. | 252/8.552 |
| 5,013,462 | 5/1991 | Danley | 252/8.554 |
| 5,075,361 | 12/1991 | Derosa et al. | 524/64 |
| 5,132,005 | 7/1992 | DeRosa et al. | 208/44 |
| 5,133,781 | 7/1992 | DeRosa et al. | 44/300 |

FOREIGN PATENT DOCUMENTS

| | | | |
|---|---|---|---|
| 0471025 | 9/1978 | U.S.S.R. | 208/44 |

*Primary Examiner*—Robert L. Stoll
*Assistant Examiner*—Daniel S. Metzmaier
*Attorney, Agent, or Firm*—James J. O'Loughlin; Vincent A. Mallare

[57] ABSTRACT

A composition of matter useful as an asphaltene dispersant, comprising a mixture of:

(a) poly[P,P'-(propylene oxide-400)phosphite) poly[di(-propylene oxide--400)diol)]]-P,P diasphalenate;

(b) poly[P,P'-(propylene oxide-400)phosphite -poly[di(-propylene oxide--1000) diol)]]-P,P'-diasphalenate;

(c) Poly[P,P'-(propylene oxide-400)phosphite) -poly(-propylene oxide-400-poly(propylene oxide-1000)di-ol)]]-P-P'-diasphalenate (d) Poly[P,P'-(propylene oxide-1000)phosphite -poly[-di(propylene oxide-400) diol)]]-P,P'-diasphalenate;

(e) poly[P,P'-(propylene oxide-1000)phosphite) poly[-di(propylene oxide-1000)diol)]]-P,P'-diasphalenate;

(f) poly[P,P'(propylene oxide-1000)phosphite) poly[-di([propylene oxide-400-poly (propylene oxide-1000)diol)]]-P,P'-diasphaltenate;

(g) cyclo[P,P'-di(polypropylene oxide -400)phosphite]-P,P'-diasphaltenate;

(h) cyclo[P,P'-di-(polypropylene oxide-1000) phosphite]-P,P'-diasphaltenate;

(i) cyclo[P,P'-(polypropyleneoxide-400) -(polypropyleneoxide-1000)-phosphite]-P,P'diasphaltenate;

(j) poly[(dipropyleneoxide-400)phosphite) diol]asphaltenate;

(k) poly[dipropyeneoxide-1000) phosphite)diol]asphaltenate;

(l) poly[(propyleneoxide-400)-propyleneoxide-1000)phosphite;

(m) poly[cyclo(propyleneoxide-400)phosphite]asphaltenate; and (n) poly[cyclo(propyleneoxide-1000) phosphite]asphaltenate.

1 Claim, No Drawings

COMPOSITION OF MATTER FOR OLIGOMERIC ALIPHATIC ETHER ASPHALTENES AS ASPHALTENE DISPERSANTS

BACKGROUND OF THE INVENTION

This invention is related to a composition of matter used for the compatibilization of asphaltenes in natural and processed bituminous liquids utilizing pendant groups that behave as solubilizers and dispersants to the asphaltenes.

Optimum petroleum refining is achieved when useful chemical conversion is conducted while minimizing energy input into the process. There are, however, intrinsic limits to this processing scenario. For example, asphaltenes comprise 10% to 20% of crude oil and their conversion to useful chemical agents is extremely limited. Moreover, the presence of heteroatoms and metal atoms encapsulated in asphaltene nuclei are known environmental toxins, especially when concentrated.

Asphaltenes are components of the bitumen in petroleum, petroleum products and other bituminous materials Moreover, once the structural modification has been performed, the material itself behaves as a catalytic agent once brought in contact with unmodified asphaltenes.

They comprise between 10 weight percent and 20 weight percent of crude petroleum. They may be superficially characterized as being readily soluble in carbon disulfide but insoluble in paraffinic naphtha. They have resisted any indepth structural characterization for a variety of reasons including, especially, their predisposition to linear "stacking." By virtue of their presence in relatively high concentrations, there is a strong economic impetus for both further delineating their structure and investigating methods to increase their conversions to useful materials.

An object of this in invention is to provide a method of stabilizing asphaltenes in Bunker "C". oil.

A further object of this invention is to provide a method of stabilizing asphaltenes in Bunker "C" oil containing Light Recycle Gas Oil.

DISCLOSURE STATEMENT

In searching extensively through prior art references and materials, applicants did not uncover any relevant prior art that pertains to the present invention.

SUMMARY OF THE INVENTION

This invention provides a composition of matter for improved asphaltene dispersion in bituminous liquids.

The composition of matter comprises a mixture of:

(a) poly[P,P'-(propylene oxide-400)phosphite) poly[di(-propylene oxide--400)diol)]]-P,P diasphaltenate;

(b) poly[P,P'-(propylene oxide-400)phosphite -poly[di(-propylene oxide--1000) diol)]]-P,P'-diasphalenate;

(c) Poly[P,P'-(propylene oxide-400)phosphite) -poly(-propylene oxide-400-poly(propylene oxide-1000)diol)]]-P-P'-diasphalenate (d) Poly[P,P'-(propylene oxide-1000)phosphite -poly[-di(propylene oxide-400) diol)]]-P,P'-diasphalenate;

(e) poly[P,P'-(propylene oxide-1000)phosphite) poly[-di(propylene oxide-1000)diol)]]-P,P'-diasphalenate;

(f) poly[P,P'(propylene oxide-1000)phosphite) poly[-di([propylene oxide-400-poly (propylene oxide-1000)diol)]]-P,P'-diasphaltenate;

(g) cyclo[P,P'-di(polypropylene oxide -400)phosphite]-P,P'-diasphaltenate;

(h) cyclo[P,P'-di-(polypropylene oxide-1000) phosphite]-P,P'-diasphaltenate;

(i) cyclo[P,P'-(polypropyleneoxide-400) -(polypropyleneoxide-1000)-phosphite]-P,P'diasphaltenate;

(j) poly[(dipropyleneoxide-400)phosphite)diol]asphaltenate;

(k) poly[dipropyeneoxide-1000) phosphite)diol]asphaltenate (l) poly[(propyleneoxide-400)-propyleneoxide-1000)phosphite asphaltenate;

(m) poly[cyclo(propyleneoxide-400)phosphite]asphaltenate; and (n) poly[cyclo(propyleneoxide-1000) phosphite]asphaltenate.

The fourteen materials making up the present composition are structurally represented in the order named above as:

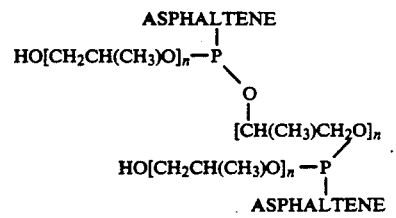

(a)

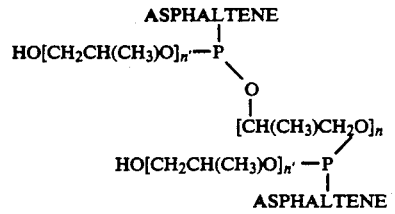

(b)

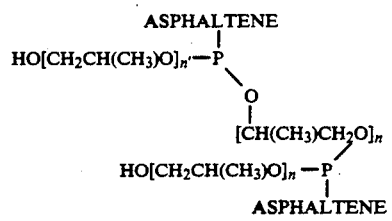

(c)

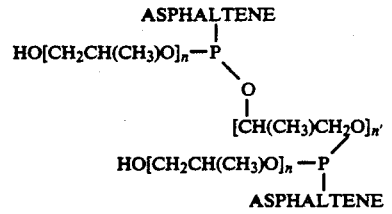

(d)

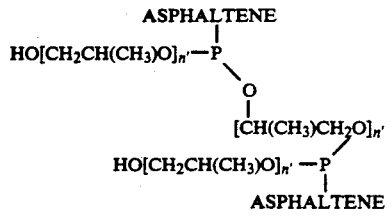

(e)

-continued (f)

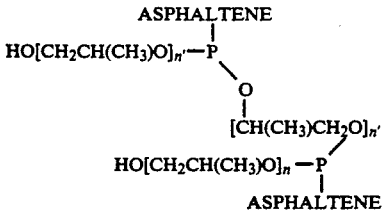

(g)

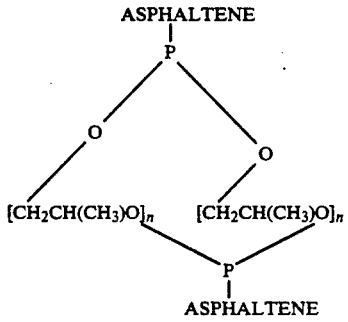

(h)

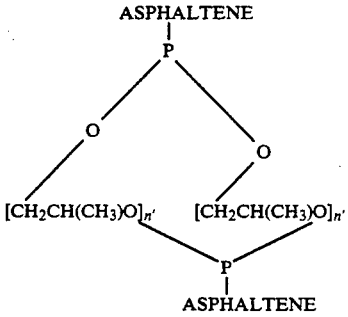

(i)

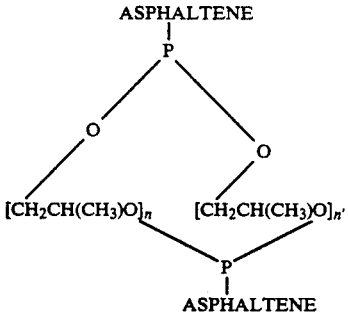

(j)

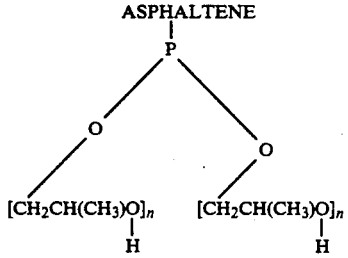

-continued (k)

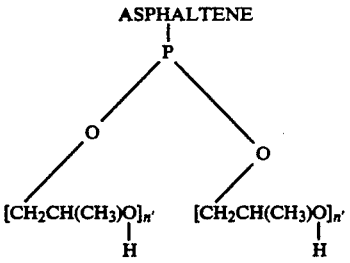

(l)

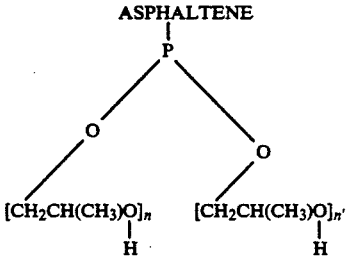

(m)

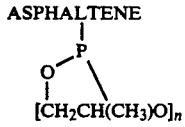

(n)

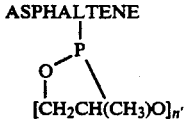

In the above formulas, n=4–8 and n'=14–20.

DETAILED DESCRIPTION OF THE INVENTION

Asphaltenes are components of the bitumen in petroleum, products, and other bituminous materials which are soluble in carbon disulfide, but insoluble in paraffin naphtha. The physical and chemical characteristics of asphaltenes have been the subject of considerable investigation for at least a century. The asphaltene molecule appears to carry a core of approximately five stacked flat sheets of condensed aromatic rings, one above the other giving an overall height of 16–20 angstroms. The average sheet diameter appears to be about 8.5 to 15 angstroms. The average sheet diameter appears to be about 8.5 to 15 angstroms. The molecular weight of petroleum asphaltenes ranges from about 1,000 to 10,000.

Shale oil asphaltenes appear to have a lower molecular weight.

Qualitative and semiquantitative detection of asphaltenes and bituminous liquids, e.g., petroleum and petroleum derived liquids, is conventionally carried out by observing the precipitation of asphaltenes by naphtha addition.

The presence of asphaltenes in bituminous liquid, e.g., petroleum crude, refinery streams, and other natural and processed bituminous liquids, is well known as are the problems resolving from the presence and precipitation of the asphaltenes. In petroleum production, for example, it has long been known that asphaltenes may, under some circumstances, precipitate to form a sludge which plugs up the oil bearing formation and prevents the recovery of additional petroleum. Sludge in such compositions is known to form in petroleum bearing formations, on valves, pump impellers, in conduits, and in other bituminous liquid handling equipment.

Generally, it is regarded as an advantage to keep the asphaltenes in a stable suspension in the bituminous liquid until well into the refining process. This not only increases the ultimate yield but prevents or reduces maintenance problems and also improves productivity from bituminous liquid bearing formations.

The present method for improving the compatibility of asphaltenes in Bunker "C" oil and Bunker "C" oil blends entails bulk phosphochlorination of the asphaltene followed by bulk of the phosphochlorinated-asphaltene intermediate. The dispersant is prepared by reacting a phosphorus trihalide with a mixture of polypropylene glycols. The polypropylene glycols, namely, PPG-400 and PPG-1000, which have molecular weights of 400 and 1000 atomic molecular units (amu's), respectively, are structurally represented below:

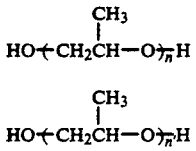

PPG-1000

Both materials are produced and sold under the trademarks PPG-400 and PPG-1000, by Texaco Chemical Company of Austin, Tex.

One or two weight percent of the dispersant is blended with unmodified asphaltenes. The phosphite dispersant is an admixture of tri(aliphatic polyether) phosphite and an oligomeric di- and tripoly(aliphatic ether-co-phosphite). The novel dispersant is characterized as possessing linear and trigonal phospho-oxygen bonding as indicated by 31P-NMR and a molecular weight of from approximately 3000 amu to 30,000 amu.

The active dispersant in this invention is a polysubstituted-phosphorus asphaltenate which is prepared in a two step process. The extraordinarily large spatial requirements for the asphaltene preclude polymer formation. The catalyst preparation is illustrated and provided below in Equations 1 and 2. The steps are Step 1. Phosphochlorination of Asphaltene Asphaltene is initially dissolved in tetrahydrofuran (THF) and phosphochlorinated using phosphorous trichloride. Asphaltene dissolution in THF permits extensive and homogeneous asphaltene phosphochlorination. Phosphochlorination using $PCl_3$ is shown below in Equation 1.

Eq. 1:

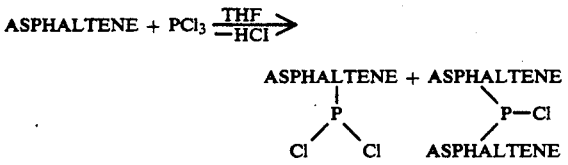

Step 2. Alkoxylation of Phosphochlorinated Asphaltene

Phosphochlorinated asphaltenes react readily with polyether diols generating phospho-alkoxylated asphaltenes. This post-reaction process is illustrated below in Equation 2 using a polyether diol of repeat unit n, which equals 4–8.

Eq. 2:

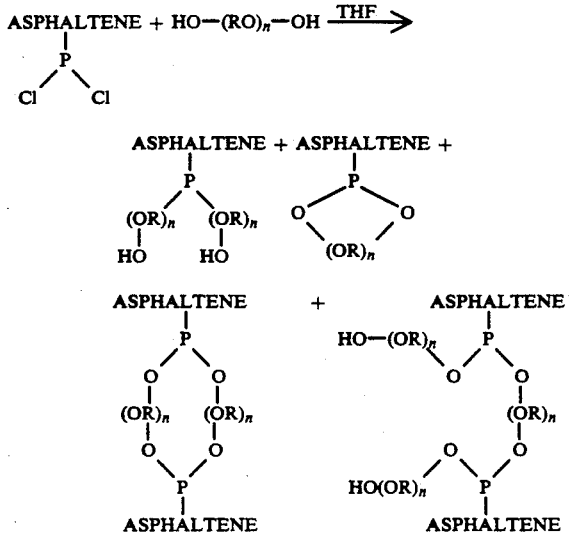

In order to show the effectiveness and advantages of the present invention, the following examples are provided:

EXAMPLE I

Synthesis of A Phosphochlorinate Asphaltene

Asphaltenes were obtained from Bunker "C" oil using n-heptane and were thoroughly dried and ground to 40 mesh power. Phosphochlorinations were performed by adding 0.1 to 10 wt. % neat $PCl_3$ to 1 to 10 wt. % asphaltenes dissolved in THF at reflux temperature under anhydrous conditions. The mixture was permitted to react under these conditions from 1 to 75 hours. Phosphochlorinated asphaltenes are isolated by removing unreacted $PCl_3$ and THF through atmospheric or vacuum distillation. This intermediate was stored under anhydrous conditions pending subsequent reaction.

EXAMPLE II

Preparation of A Phosphoalkoxylated Asphaltene

Sufficient PPG-400 with a molecular weight of 400 amu is dissolved in 50 to 500 mls anhydrous THF and added to phosphochlorinated asphaltenes derived from the aforementioned example to cause complete alkoxylation to occur. The phosphoalkoxylated asphaltene is isolated through atmospheric or vacuum distillation.

EXAMPLE III

Preparation of a Phosphoalkoxylated Asphaltene

In this Example, PPG-1000 (Polypropylene glycol with a molecular weight of 1000 amu) may be substituted for the PPG-400 in Example II.

EXAMPLE IV

Preparation of a Phosphoalkoxylated Asphaltene

A 1:1 mole-mole mixture of PPG-400 and PPG-1000 may be substituted for the PPG-400 in Example II.

EXAMPLE V

Preparation of a Phosphoalkoxylated Asphaltene

A 1:1 mole mixture of PPG-400 and PPG-1000 may be substituted for the PPG-400 in Example II.

Material Evaluation

The novel reaction products of this invention were evaluated according to the Spot Test as outlined in the ASTM D 2781 test method. In the spot test, Bunker "C" oil or Bunker "C" blend containing Light Recycle Gas Oil and the modified or unmodified asphaltene are heated to 150° C. for a specified time and the sample removed and agitated for a specified duration. One drop of t he mixture is placed onto a sheet of filter paper using a glass rod. The filter paper is baked in the oven and oil diffuses radically from the point of addition to give a uniform brown circle. Any asphaltenes which have precipitated during this process appear as a ring of darker material. The sample is rated using integers on a scale of one through five, the higher numbers indicating that precipitation has occurred.

Tables I through V, below, provide a summary of these spot test results.

TABLE I

Spot Testing Results Using ASTM Test Method D 2781 For Unmodified Asphaltene Samples Used As References.

| Sample | Spot Test Rating |
|---|---|
| 1 wt % Asphaltene + 99 wt % Bunker "C" oil | 3 |
| 2 wt % Asphaltene + 98 wt % Bunker "C" oil | 3 |
| 1 wt % Asphaltene + 99 wt % 4:1 wt/wt Light Recycle Gas Oil and Bunker "C" oil | 3 |
| 2 wt % Asphaltene + 98 wt % 4:1 wt/wt Light Recycle Gas Oil and Bunker "C" oil | 3 |

TABLE II

Spot Test Results Using ASTM Test Method D 2781 And A 1 wt % Sample In Bunker "C" Oil.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-400 + PPG-1000) | 1 |

TABLE III

Spot Test Results Using ASTM Test Method D 2781 And A 2 wt % Sample In Bunker "C" Oil.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + (PPG-400 + PPG-1000) | 1 |

TABLE IV

Spot Test Results Using ASTM Test Method D 2781 And A 1 Wt % Sample In A 4:1 wt/wt Blend Of Light Recycle Gas Oil And Bunker "C" Oil, Respectively.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + (PPG-400 + PPG-1000) | 1 |

TABLE V

Spot Test Results Using ASTM Test Method D 2781 And A 2 wt % Sample In A 4:1 wt/wt Blend Of Light Recycle Gas Oil And Bunker "C" Oil, Respectively.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-400 + PPG-1000) | 1 |

As the foregoing data indicate, this dispersant causes dramatic compatibilization in Bunker "C" oil and Bunker "C" oil blends containing Light Recycle Gas Oil. Less dramatic results are obtained by the incorporation of surface active agents onto asphaltenes. Finally, little emulsifying effect was observed by blending unmodified asphaltenes with Bunker "C" oil and oil blends containing amidated trichlorophosphorous.

We claim:

1. A composition of matter comprising a mixture of:

(a) poly[P,P'-(propylene oxide-400)phosphite) poly[di(-propylene oxide--400)diol)]]-P,P'diasphalenate;

(b) poly[P,P'-(propylene oxide-400)phosphite -poly[di(-propylene oxide--1000) diol)]]-P,P'-diasphalenate;

(c) Poly[P,P'-(propylene oxide-400)phosphite) -poly(-propylene oxide-400-poly(propylene oxide-1000)diol)]]-P-P'-diasphalenate (d) Poly[P,P'-(propylene oxide-1 000)phosphite -poly[-di(propylene oxide-400) diol)]]-P,P'-diasphalenate;

(e) poly[P,P'-(propylene oxide-1000)phosphite) poly[-di(propylene oxide-1000)diol)]]-P,P'-diasphalenate;

(f) poly[P,P'(propylene oxide-1000) phosphite) poly[-di([propylene oxide-400-poly (propylene oxide-1000)diol)]]-P,P'-diasphaltenate;

(g) cyclo[P,P'-di(polypropylene oxide-400)phosphite]-P,P'-diasphaltenate;

(h) cyclo[P,P'-di-(polypropylene oxide-1000) phosphite]-P,P'-diasphaltenate;

(i) cyclo[P,P'-(polypropyleneoxide-400)-(polypropyleneoxide-1000)-phosphite]-P,P'diasphaltenate;

(j) poly[(dipropyleneoxide-400)phosphite) diol]asphaltenate;

(k) poly[dipropyeneoxide-1000) phosphite)diol]asphaltenate;

(l) poly[(propyleneoxide-400)-propyleneoxide-1000)phosphite (m) poly[cyclo(propyleneoxide-400)phosphite]asphaltenate; and (n) poly[cyclo(propyleneoxide-1000) phosphite]asphaltenate.

* * * * *